US006112956A

United States Patent [19]

Malone

[11] Patent Number: 6,112,956

[45] Date of Patent: Sep. 5, 2000

[54] QUANTITY CONTROLLED, FLUENT MATERIAL DISPENSING APPARATUS

[76] Inventor: Morris Malone, 11122 Valley Ave., E., Puyallup, Wash. 98372

[21] Appl. No.: 08/995,383

[22] Filed: Dec. 22, 1997

[51] Int. Cl.[7] ..... B65B 1/00

[52] U.S. Cl. ..... 222/642; 222/161; 222/608; 141/231; 141/313

[58] Field of Search ..... 222/161, 608, 222/638, 639, 642, 644–646; 141/231, 313–317

[56] References Cited

U.S. PATENT DOCUMENTS

| | | | |
|---|---|---|---|
| 2,586,557 | 2/1952 | Newbold | 226/59 |
| 2,879,042 | 3/1959 | Jones | 222/642 |
| 3,552,346 | 1/1971 | Garden | 141/313 |
| 3,788,016 | 1/1974 | Richardson | 52/66 |
| 4,437,595 | 3/1984 | Stevens et al. | 222/642 |
| 5,215,127 | 6/1993 | Bergeron | 141/10 |
| 5,414,261 | 5/1995 | Kanzler et al. | 141/313 |
| 5,437,318 | 8/1995 | Kanzler et al. | 141/313 |
| 5,547,113 | 8/1996 | Chen | 222/642 |

*Primary Examiner*—J. Casimer Jacyna
*Attorney, Agent, or Firm*—Dean A. Craine

[57] ABSTRACT

A fluent dispensing apparatus with a timer control valve that controls the amount of fluent material dispensed into the bag or flexible container. The apparatus includes a holding tank filled with fluent material, such as sand. Formed in the tank is at least one hopper having a lower chute. A sliding gate is disposed over the lower opening of the chute which is coupled to a pneumatic arm. Movement of the pneumatic arm is coupled to an adjustable timer so that the sliding gate automatically opens and closes after a pre-determined length of time. By adjusting the timer so that after a pre-selected length of time the sliding gate is opened, the same quantity of sand may be deposited into each bag. By adjusting the timer so that a sliding gate is closed after a selected length of time, the number of bags produced over a specific period of time may be controlled. The hopper is designed for side-filling for easier filling and an optional vibrator is disposed inside the hopper to facilitate the filling process. The apparatus is constructed on a trailer so that it may be easily transported by a motor vehicle to different locations.

3 Claims, 3 Drawing Sheets

QUANTITY CONTROLLED, FLUENT MATERIAL DISPENSING APPARATUS

BACKGROUND OF THE INVENTION

1. Field of the Invention

This invention relates to an apparatus used to manually dispense fluent material into containers and, more particularly, to such an apparatus in which the amount of fluent material dispensed in each container may be pre-selected to dispense the same amount of fluent material in each container.

2. Description of the Related Art

Using sandbags to build a dyke is a common way to prevent flooding. Generally, it is recommended that the dyke be built approximately two feet higher than the anticipated water level and have a base three times as wide as it is high. For example, if the water level rises three feet, the dyke should be five feet high and fifteen feet wide. Needless to say, to build a dyke, a large quantity of sandbags are required. For example, to build 100 linear feet of dyke, three feet high requires approximately 3,400 sandbags.

Typically, a sandbag is comprised of a bag made of burlap or polyethylene material partially filled with sand. The bags are filled approximately half-full and weigh approximately thirty-five pounds. The end of each bag is untied leaving a large upper, unfilled portion. During transportation, the unfilled portion of the bag acts as a flap which may be folded over to prevent spillage. When constructing a dyke, the sandbags are stacked in off-set rows with the unfilled portion extended longitudinally over the lower adjacent sandbag so that a longitudinally aligned adjacent sandbag is placed over the upper, unfilled portion of the sandbag to interlock the adjacent sandbags in the same row. In order to create a stable dyke, it is important that the quantity of sand and the upper, unfilled portion on each sandbag be the same.

The process of manually manufacturing hundreds or thousands of sandbags to construct a temporary dyke is very fatiguing and potentially injurious to a worker's back. Even when a dispensing apparatus is used, such as the apparatus disclosed in U.S. Pat. Nos. 5,417,261 and 5,437,318, workers must fill sandbags partially bent over at the waist, which puts tremendous stress on the worker's lower back muscles. As a result, back injuries are common among sandbagging workers.

An apparatus is needed that automatically dispenses a pre-determined quantity of sand into a sandbag so that the quantity of sand and the size of the unfilled portion of each sandbag is the same. Such an apparatus is also needed that is less stressful to workers than other dispensing apparatus' currently available.

SUMMARY OF THE INVENTION

It is an object of the invention to provide an apparatus to easily and quickly dispense fluent material, such as sand, into a bag.

It is a further object of the invention to provide such an apparatus in which the quantity of sand dispensed may be controlled to quickly and easily manufacture a plurality of sandbags having the same quantity of sand and unfilled portions.

It is another object of the invention to provide such an apparatus which is less stressful to workers than other fluent dispensing apparatus'.

These and other objects are met by providing an apparatus designed to easily and quickly dispense fluent material, such as sand, into flexible containers or bags. The amount of sand dispensed into each bag is selectively adjusted to accurately and consistently dispense a pre-determined quantity of sand into each bag. The apparatus includes a specially designed holding tank with one or more bag filling stations created therein. Each filling station includes a hopper section with a side-oriented chute so that sand is dispensed near one side of the apparatus, thereby enabling workers to fill sandbags in an upright position.

Each hopper section includes an adjustable timer controlled gate means disposed over the chute that controls the amount of sand dispensed from the chute and into the sandbags. In the embodiment described herein, the timer controlled gate means includes a sliding gate which moves transversely through the chute, an activating means is coupled to the sliding gate, and an adjustable timer mechanism is connected to the activating means. The adjustable timer mechanism controls the amount of time the sliding gate opens and closes. A vibrating means is attached to the sides of the holding tank which, when activated, dislodges sand from the side of each hopper to maintain a constant flow of sand into each chute during use. By adjusting the timer mechanism so that the chute is opened for a specific period, a uniform amount of sand may be dispensed into each bag. Also, by adjusting the timer mechanism so that the chute is closed a specific length of time, the working pace of the worker may be controlled thereby assuring that a desired quantity of sandbags is manufactured over a specific period.

In the embodiment shown, the apparatus is constructed on an optional trailer so that it may be easily transported by a motor vehicle to different locations.

DESCRIPTION OF THE PREFERRED EMBODIMENT(S)

Figure 1:
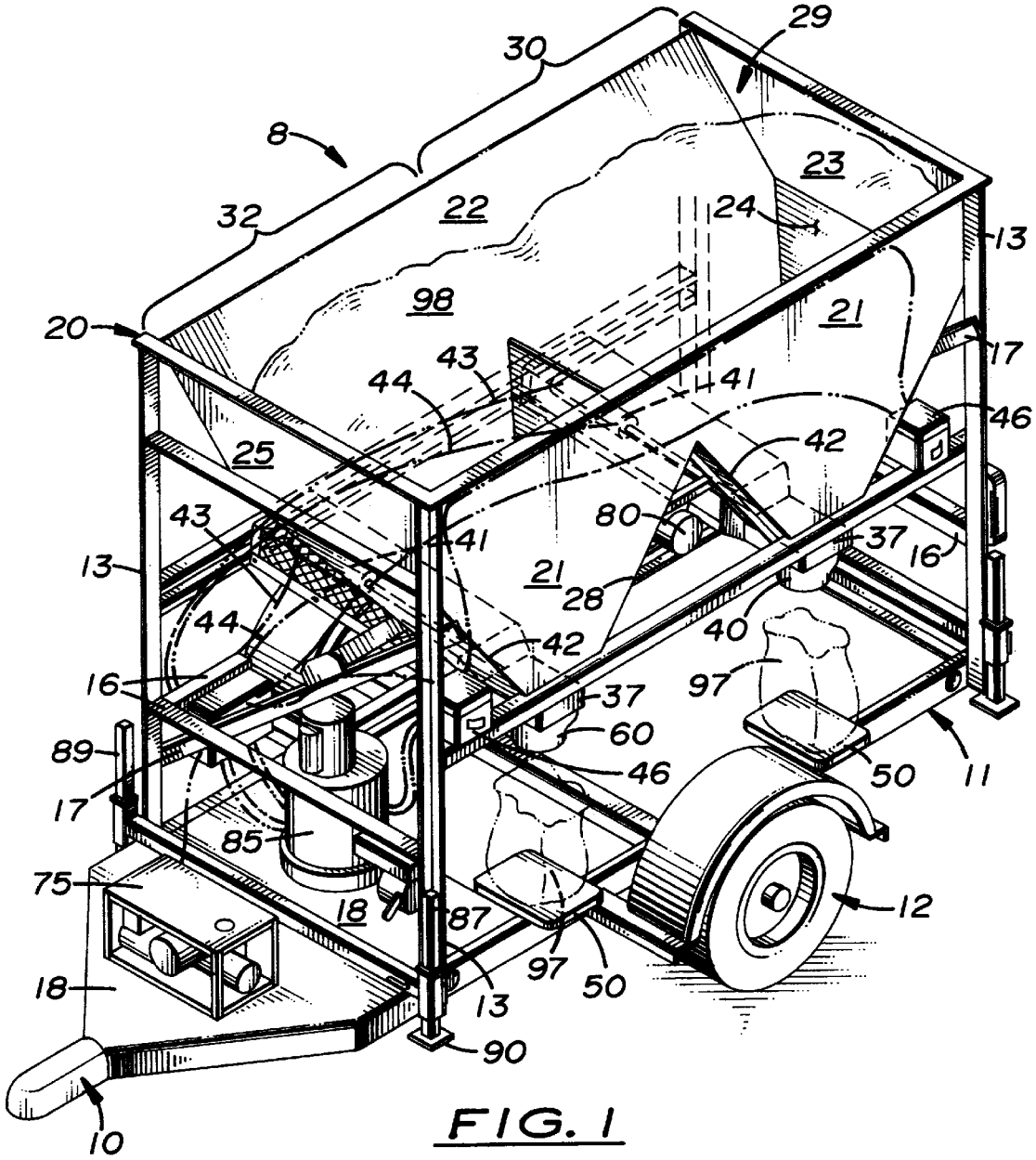
FIG. 1 is a perspective view of the apparatus.

The present invention in one embodiment finds preferred usage as a portable apparatus 8 used to make sandbags. During typical usage, the apparatus 8 is transported to a location where a large quantity of sandbags 97 are needed to construct a dyke or levy. Sand 98 is usually deposited nearby which is deposited into the apparatus 8 by a loader to make a large quantity of sandbags 97.

The apparatus 8 includes a holding tank 20 capable of holding a large quantity of sand 98. In the embodiment shown, the holding tank 20 is a large rectangular structure designed to hold approximately four cubic yards of sand. The holding tank 20 includes a vertically aligned front wall 21, a diagonally aligned backwall 22, a vertically aligned right upper wall section 23, a diagonally aligned right lower wall section 24, a vertically aligned left upper wall section 25, and a diagonally aligned left lower wall section 26. Disposed transversely inside the holding tank 20 is a diagonally aligned right inside wall 27 and a diagonally aligned left inside wall 28 which divides the holding tank 20 into a right hopper 30 and a left hopper section 32. The lower edges of the right half of the backwall 22, the right inside wall 27 and, the right lower wall section 24 both converge inward and join the upper edge of a lower chute 40. The lower edges of the left half of the backwall 22, the left inside wall 28, and the left lower section 26 all converge inward and join the upper edge of a lower chute 60. The holding tank 20 has a large top opening 29 to enable sand 98 to be deposited therein via a loader. The chutes 40, 60 are vertically aligned, cylindrical-shaped structures with a central passageway and top and bottom openings so that sand 98, deposited in the adjoining hopper 30, 32, respectively, may pass therethrough.

Figure 2:
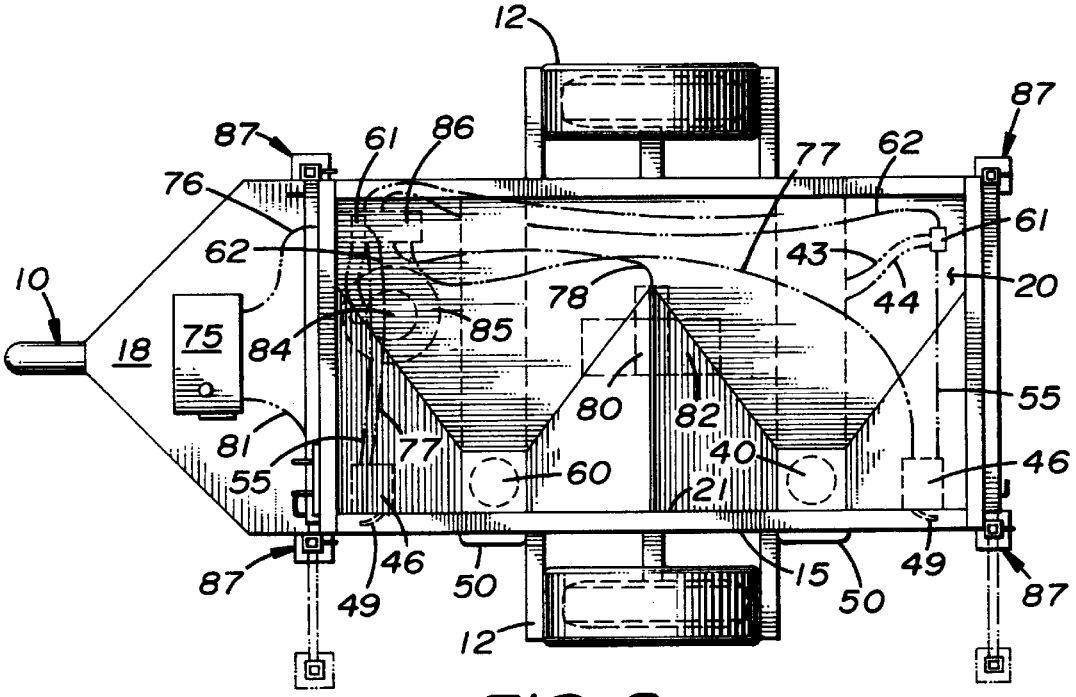
FIG. 2 is a top plan view of the apparatus.
Figure 3:
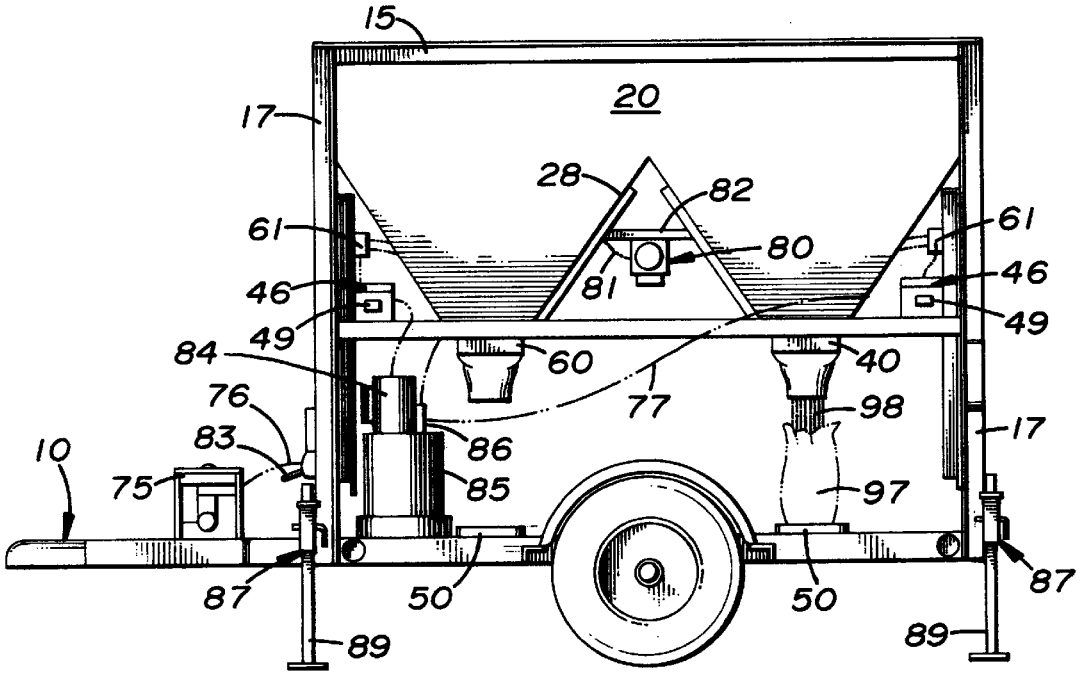
FIG. 3 is a left elevational view of the apparatus.
Figure 4:
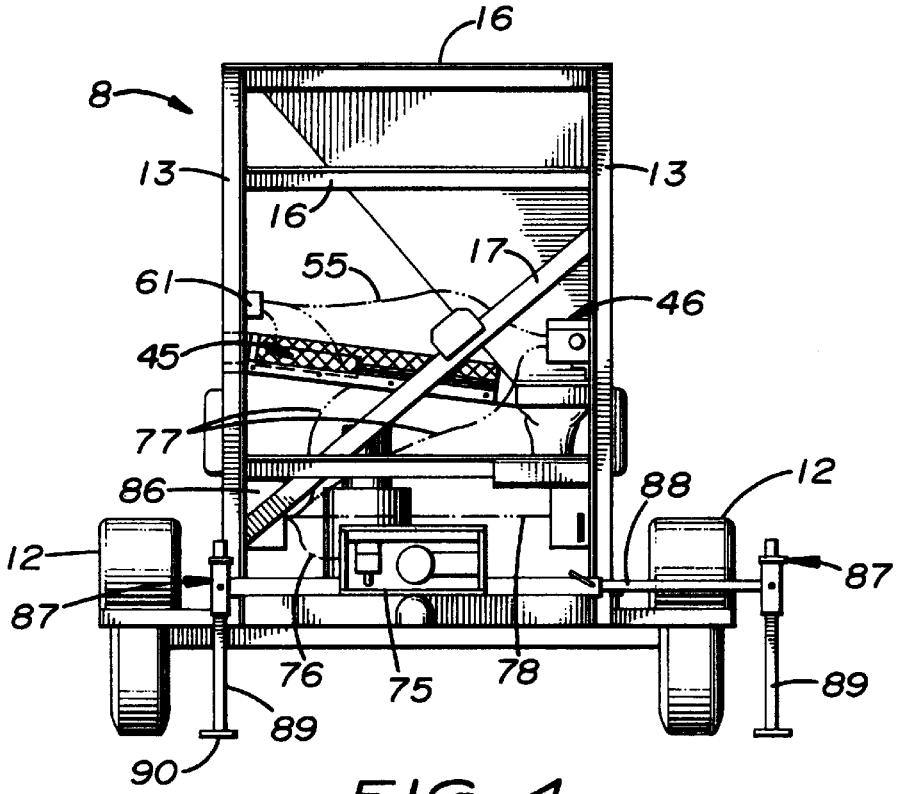
FIG. 4 is a front elevational view of the apparatus.
Figure 5:
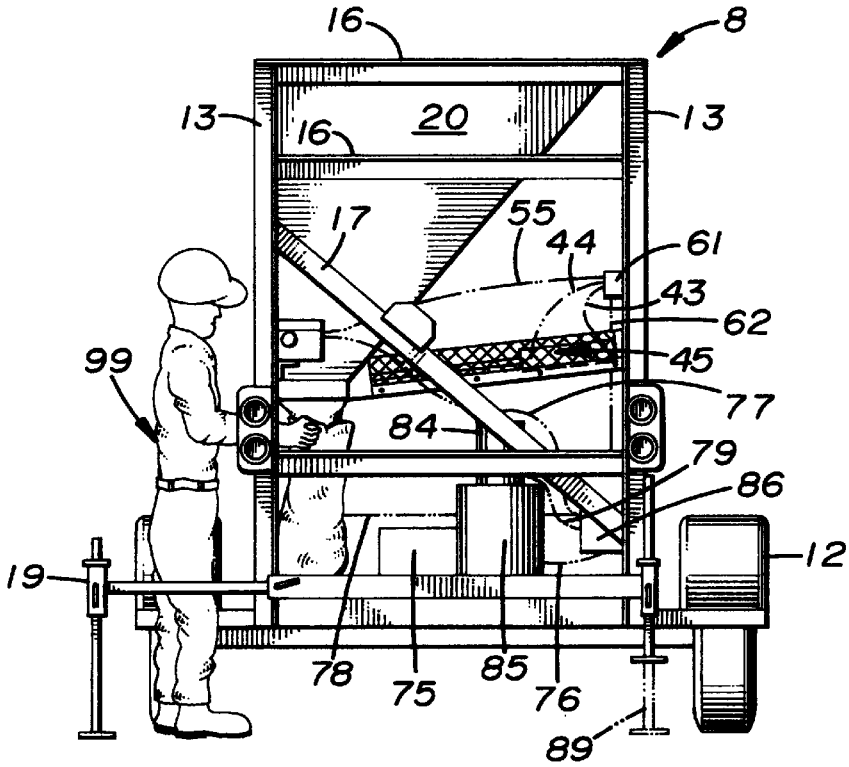
FIG. 5 is a rear elevational view of the apparatus.

Disposed over the lower opening of each chute 40, 60 is a gate means which opens and closes to control the amount of sand dispensed from the adjoining hopper sections 30, 32, respectively. In the embodiment shown in FIG. 1, each gate 37 means includes a sliding gate capable of completely closing the chute's central passageway. Each sliding gate 37 is coupled to the central arm 42 that extends and retracts from a pneumatic cylinder 41 to move the sliding gate 37 transversely through the adjoining chute 40 or 60. Air inlet and outlet tubes 43, 44 are connected at their distal ends to the pneumatic cylinder 41. The proximal ends of the inlet and outlet tubes 43, 44 are connected to a control valve 61 mounted near each cylinder 41 shown in FIG. 2. A main fluid line 62 connects each control valve 61 to an air tank 85 mounted on the flat support surface 18. In the preferred embodiment, the air tank 85 is pressurized between 100–150 lbs.

An adjoining protective shroud 45 surrounds each cylinder 41 and arm 42. Attached to the rear surface of each chute 40, 60 is an "L" shaped brace 53. A bushing 54 is attached to the brace 53 designed to keep the end of the arm 42 in position. A slot (not shown) is formed on the rear surface of each chute 40, 60 to enable the slide gate 37 to move transversely through the chutes 40, 60 during use.

Located on the front section of the trailer 10, is a gasoline power generator 75. The generator 75 provides 220 volt (a.c.) electric power to a fuse box 86 via wire 76. The fuse box 86 is connected to a 110 volt (a.c.) electric air compressor 84 via wire 79. The generator 75 also provides electric power from the fuse box 86 to each adjustable timer 46 via wires 77 and to the vibrator control switch 83 via wire 81, each discussed further below.

An adjustable timer 46 is connected to each cylinder 41 to control the amount of air pressure delivered thereto. Since each cylinder 41 is connected to one sliding gate 37, the timer 46 is used to control the length of time the sliding gate is opened and closed. By controlling the length of time the sliding gate 37 is open, a uniform quantity of sand 98 is dispensed from the adjoining hopper 30 or 32. Since no human action is required, each sandbag 97 is filled with the same amount of sand 98. By controlling the length of time the sliding gate 37, 57 is closed, the number of sandbags 97 manufactured in a desired period may be controlled. In the embodiment shown, each timer 46 includes an outer housing 47 with a 110 volt timer mechanism 48 contained therein. A manually operated switch 49 is connected to each timer mechanism 48 enabling each worker to independently activate and deactivate the timer 46 when filling sandbags 97. Each timer 46 is electrically connected to a control valve 61 via a wire 55 to control the direction of flow of pressurized air therethrough. The main supply line 62 delivers pressurized air to each control valve 61. The pneumatic inlet and outlet tubes 43, 44 are connected between the control valve 61 and each cylinder 41 to transmit pressurized air therebetween.

Attached to the sides of the tank 20 is a vibrator 80. In the embodiment shown, the vibrator 80 is attached to a horizontal support plate 82 connected at its opposite ends to the lower surface of the two adjacent hoppers 30, 32. During use, the vibrator 80 vibrates the sides of each hopper 30, 32 to dislodge sand 98 therefrom so it will fall into the adjoining chute 40, 60, respectively. In the embodiment shown, the vibrator 80 is a 110 volt, ⅓ to ½ hp., centrifugal, counter-weight type vibrator. A switch 83 is connected to the vibrator 80 which is used to selectively turn the vibrator 80 "on" or "off". A wire 78 electrically connects the vibrator 80 to the fuse box 86.

Attached to the upper surface of the trailer 10 and directly below the lower opening on each chute 40, 60 is a bag support 50. During operation, an empty bag 96 is placed in the bag support 50 and filled with sand 98.

In FIGS. 1–4 the apparatus 8 is shown assembled on an optional trailer 10. It should be understood that the apparatus 8 could be assembled on the bed of a truck. The trailer 10 includes two tire assemblies 12 attached to a trailer frame 11. Attached to each corner of the trailer frame 11 is a vertically aligned frame member 13. The upper ends of two vertically aligned frame members 13 located along the front surface of the trailer 10 are interconnected by a horizontally aligned frame member 15. A middle, horizontally aligned frame member 14 is disposed between the two vertically aligned frame members 13 at approximately the mid-elevation to provide stability. Attached over the tongue and the front sections of the trailer 10 is a flat support surface 18, made of steel plate material, upon which the generator 75, compressor 84 and air reservoir tank 85, or other objects may be positioned.

Attached to each corner of the trailer frame 11 are optional adjustable legs 87 which can be extended horizontally and vertically therefrom. During use, the legs 87 are used to stabilize the apparatus 8 on unlevel ground. Each leg 87 includes an adjustable, laterally adjusted arm member 88 and a vertically adjustable arm member 89 perpendicularly aligned and attached to the distal end of the arm member 88. Attached to the distal end of the arm member 89 is a wide foot 90.

As mentioned above, the holding tank 20 has a flat, vertically aligned front wall 21 which enables adjoining chutes 40, 60 to be aligned near the front side of the trailer 10. This allows workers to stand in an upright position adjacent to the chutes 40, 60 and fill sandbags 97, thus reducing fatigue and back injuries.

Initially, apparatus 8 is transported to a location and set up where a large quantity of sandbags 97 are to be manufactured. A large quantity of sand 98 and empty bags 96 are also delivered to the location. During the setup procedure, the extendable legs 87 on the apparatus 8 are horizontally and vertically adjusted in position so that the apparatus 8 is level and stable during operation. Sand 98 is then deposited into the two hopper sections 30 and 32. Bags 96 are positioned near each bag support 50.

Each timer 46 is then set for a particular filling cycle according to the size of the sandbag 97 to be manufactured. Each filling cycle includes a closed period and an opened period. During the closed period, a sufficient amount of time elapses so that a worker is able to remove a filled sandbag 97 from the bag support 50 and then select an empty bag 96 and position it below the chute 40 or 60. During the opened period, a sufficient amount of time elapses so that a desired quantity of sand is dispensed from the hopper section 30 or 32 into the bag 96. Typically, for adults to manufacture a forty pound sandbag, the timer 46 is set so that the closed period lasts approximately 2 to 5 seconds and the opened period lasts 1.5 seconds.

During operation, a worker is positioned in front of each chute 40, 60 and then activates the adjoining timer switch 49 to begin the sand filling process. Depending on the wetness of the sand 98, the vibrator 80 is activated to maintain a constant flow of sand 98 in each chute 40, 60. After sand 98 is dispensed into the bag 96, the sandbag 97 is removed from the bag support 50 and handed to another worker who then passes the sandbag 97 to other workers in a line. The first worker then selects another empty bag 96 and places it on the bag support 50. In this manner, a relatively large quantity of sandbags 97 may be quickly and easily manufactured in a short time.

In compliance with the statute, the invention, described herein, has been described in language more or less specific as to structural features. It should be understood, however, the invention is not limited to the specific features shown, since the means and construction shown comprise only the preferred embodiments for putting the invention into effect. For example, the apparatus can be modified to include one or more work stations, the pneumatic cylinder could be replaced with a hydraulic cylinder, and the timer could be spring operated. The invention is, therefore, claimed in any of its forms or modifications within the legitimate and valid scope of the amended claims, appropriately interpreted in accordance with the doctrine of equivalents.

What is claimed is:

1. A quality controlled, sandbagging apparatus, comprising:

a. at least one hopper capable of holding fluent material, said hopper having a vertical front wall and at least one vertically aligned discharge chute with a bottom opening, said discharge chute being disposed under and aligned with said vertical front surface to enable a worker to stand in an upright position adjacent to said discharge chute;

b. a sliding gate to open and close said discharge opening;

c. an activating means coupled to said sliding gate to open and close said sliding gate over said discharge opening; and, d. an adjustable timer coupled to said activating means to control the number of cycles said sliding gate opens and closes and the length of time said sliding gate is opened and closed to control the amount of fluent material dispensed from said hopper.

2. A sandbagging apparatus, as recited in claim 1, where said apparatus is assembled on a portable trailer capable of being transported by a motor vehicle.

3. A sandbagging apparatus, comprising:

a. at least one hopper capable of holding fluent material, said hopper having a vertical front surface and at least one vertically aligned discharge chute with a bottom opening, said discharge chute being aligned with said vertical front surface;

b. a sliding gate to open and close said bottom opening on said discharge chute;

c. an activating means coupled to said sliding gate to open and close said sliding gate over said bottom opening;

d. an adjustable timer coupled to said activating means to control the length of time said sliding gate is opened thereby controlling the amount of fluent material dispensed through said bottom opening;

e. a fluent material movement means disposed inside said hopper to facilitate the movement of fluent material out of said hopper and through said discharge opening; and, f. a portable trailer capable of transporting said apparatus.

* * * * *